US010760333B2

(12) United States Patent
Iglesias Ballester

(10) Patent No.: US 10,760,333 B2
(45) Date of Patent: Sep. 1, 2020

(54) DOUBLE CANVAS DOOR

(71) Applicant: AMISERRU, S.L., Sant Cugat del Vallés (ES)

(72) Inventor: Miguel Angel Iglesias Ballester, Sant Cugat del Vallés (ES)

(73) Assignee: AMISERRU, S.L., Barcelona (ES)

( * ) Notice: Subject to any disclaimer, the term of this patent is extended or adjusted under 35 U.S.C. 154(b) by 143 days.

(21) Appl. No.: 15/560,522

(22) PCT Filed: Feb. 5, 2016

(86) PCT No.: PCT/ES2016/070067
§ 371 (c)(1),
(2) Date: Sep. 22, 2017

(87) PCT Pub. No.: WO2016/156635
PCT Pub. Date: Oct. 6, 2016

(65) Prior Publication Data

US 2018/0112458 A1 Apr. 26, 2018

(30) Foreign Application Priority Data

Mar. 27, 2015 (ES) ..... 201530413

(51) Int. Cl.
*E06B 9/08* (2006.01)
*E06B 9/44* (2006.01)
(Continued)

(52) U.S. Cl.
CPC ..... *E06B 9/171* (2013.01); *E06B 9/13* (2013.01); *E06B 9/44* (2013.01); *E06B 2009/2458* (2013.01)

(58) Field of Classification Search
CPC .. E06B 2009/2435; E06B 9/172; E06B 9/173; E06B 9/171; E06B 9/13;
(Continued)

(56) References Cited

U.S. PATENT DOCUMENTS 2,328,257 A 8/1943 Butts
4,187,896 A * 2/1980 Shore ..... E06B 9/24 160/121.1
4,506,720 A * 3/1985 Iwanicki ..... E06B 9/24 160/121.1
(Continued)

FOREIGN PATENT DOCUMENTS

EP 0065876 12/1982
EP 0085861 8/1983
(Continued)

OTHER PUBLICATIONS

WIPO, Translation of International Search Report for PCT/ES2016/070067, dated Oct. 6, 2016.

*Primary Examiner* — Daniel P Cahn
(74) *Attorney, Agent, or Firm* — Hodgson Russ LLP

(57) ABSTRACT

The invention relates a double-canvas door; comprising a frame (1) provided with guides (2*a,* 2*b*) for moving the canvases (3*a,* 3*b*) between door open and closed positions, said canvases defining an intermediate chamber (8) therebetween. The door comprises a single motor-driven roller (6) for the simultaneous winding of both canvases, and a single motor (61) for actuating the roller, the upper ends of the canvases (3*a,* 3*b*) being connected to one another and to a band (5) coupled to the winding roller (6), said connection closing the upper end of the intermediate chamber (8) when the door is closed.

6 Claims, 4 Drawing Sheets

(51) Int. Cl.
*E06B 9/171* (2006.01)
*E06B 9/13* (2006.01)
*E06B 9/24* (2006.01)

(58) Field of Classification Search
CPC ..... E06B 9/44; E06B 2009/2458; E06B 2009/1716; E06B 9/46; E06B 9/48; E06B 2009/445
USPC ..... 160/120
See application file for complete search history.

(56) References Cited

U.S. PATENT DOCUMENTS 5,566,736 A * 10/1996 Crider ..... E06B 9/13 160/121.1
7,281,561 B2 * 10/2007 Anderson ..... E06B 9/264 160/121.1
9,353,570 B2 * 5/2016 Smith ..... E06B 9/38
2006/0207731 A1 * 9/2006 Lukos ..... E04F 10/0633 160/392
2007/0277936 A1 * 12/2007 Sirkin ..... A47H 3/02 160/84.01
2013/0098567 A1 * 4/2013 Ashelin ..... E06B 9/13 160/330
2014/0034250 A1 * 2/2014 Weiss ..... E06B 9/24 160/108
2015/0368966 A1 * 12/2015 Faller ..... E06B 9/80 160/311
2016/0130873 A1 * 5/2016 Veit ..... E06B 9/40 160/309

FOREIGN PATENT DOCUMENTS

ES 1110857 6/2014
WO 9112404 8/1991
WO 2014053485 4/2014

* cited by examiner

DOUBLE CANVAS DOOR

OBJECT OF THE INVENTION

The object of the present invention is a double-canvas door, which presents a series of specific construction characteristics that are aimed at simplifying its movement and increasing the watertightness of the chamber formed by the two canvases when the door is in the closed position.

FIELD OF APPLICATION THE INVENTION

This invention is applicable in the field dedicated to the manufacture of doors, and specifically insulating doors.

STATE OF THE ART

Doors equipped with two closing canvases mounted on vertical guides and with each upper end secured to a motorized roller, which, when they rotate in one direction or the other cause the respective canvases to roll and unroll, and consequently open and close the door, are known.

When the door is in the closed position, the two canvases create an intermediate chamber.

The intermediate chamber provides thermal insulation between the two zones separated by the door; the incorporation of a heating set into this type of door to supply temperature-controlled air to the intermediate chamber is also known.

A door of this type is described, for example, in utility model ES 1 110 857 U.

One of the general drawbacks with this type of door is the complexity of the construction and the cost as a result of the use of two winding rollers and the means required to motorize them. These means of motorization may consist of two motors, one for each roller, or a single motor and a transmission to simultaneously actuate both rollers, as in the case of the aforementioned prior art ES 1 110 857 U.

The use of two winding rollers poses a problem of watertightness of the intermediate chamber when the door is closed. Although the winding rollers are housed in an upper cover or housing, the closure of the aforementioned intermediate chamber at the upper end is practically infeasible and causes significant leaks of the temperature-controlled air blown into the chamber.

The applicant of the present invention is not aware of the existence of any prior art that satisfactorily resolves the aforementioned issues.

DESCRIPTION OF THE INVENTION

The double-canvas door of the invention presents a series of construction characteristics that enable it to resolve the aforementioned problem, greatly simplifying the simultaneous movement of the two canvases of the door and closing the top of the intermediate chamber, which significantly improves the insulation of the door in the closed position.

To achieve the proposed objectives, a double-canvas door has been developed that comprises a single roller for the simultaneous winding of both canvases and a single drive motor, which greatly simplifies door construction and cost.

The upper ends of the canvases are connected to one another and to a band coupled to the winding roller, with this connection closing the upper end of the intermediate chamber that helps keep the temperature and atmospheric conditions inside the door stable when the door is closed.

In one embodiment of the invention, to create this connection, the door comprises a connection profile with several parallel slots for securing the ends of the two canvases and a first end of the band coupled to the winding roller.

The winding roller comprises a first longitudinal slot to secure the band, and a second longitudinal slot that holds the connection profile, so that when the canvases are in the wound position, the connection between the canvases and the band does not extend beyond the general profile of the winding roller and so that the coupling between the connection profile and the second opening work together to support the tension of the canvases.

DESCRIPTION OF THE FIGURES

To complement the description that is being provided and in order to provide a better understanding of the characteristics of the invention, a set of drawings is included along with this descriptive summary, in which the following elements have been represented for the purposes of illustration but not limitation.

PREFERRED EMBODIMENT OF THE INVENTION

Figure 1:
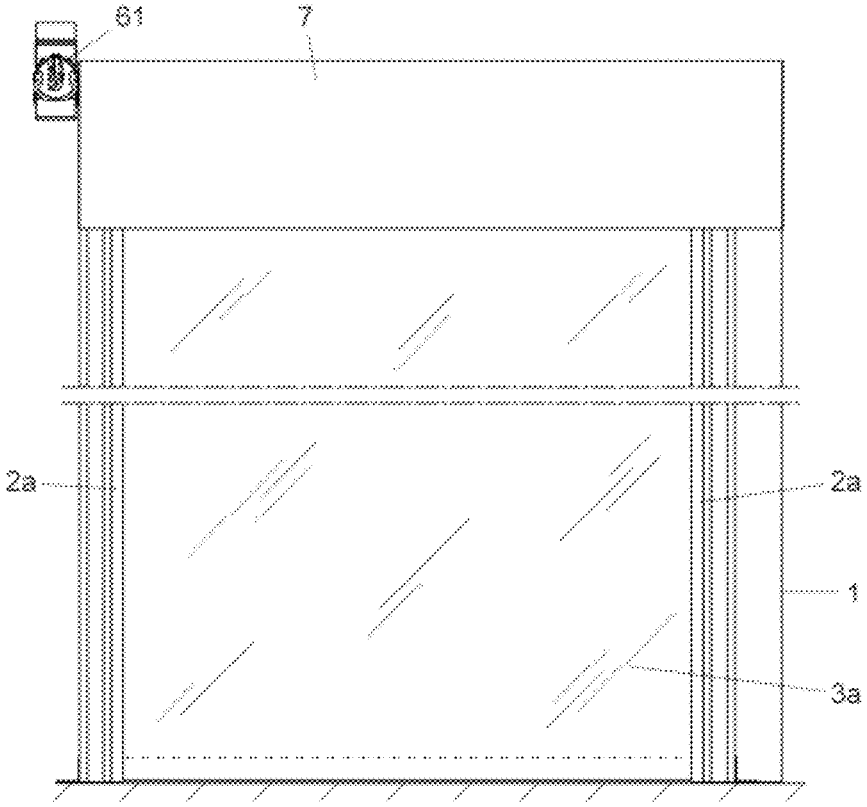
FIG. 1 shows a front elevation of an exemplary embodiment of the double-canvas door according to the invention, in the closed position.

As observed in FIGS. 1 to 3B, this double-canvas door comprises a frame (1) provided on each side with a pair of guides (2*a*, 2*b*) for moving the canvases (3*a*, 3*b*) fitted at the lower ends with tension weights (31) and connected to one another at the upper end by a connection profile (4) to a band (5) coupled to a single winding roller (6) actuated by a drive set (61) such that when the winding roller rotates in one direction or the other, the two canvases (3*a*, 3*b*) simultaneously wind or unwind on the roller (6) and consequently open or close the door. The upper part of the door is equipped with a cover (7).

As shown in FIGS. 2A-2B and 3A-3B, the canvases (3*a*, 3*b*) create an intermediate chamber (8) therebetween, which is equipped on the sides with a series of blower nozzles (9) connected by a series of conduits (91) to a heating set (10) responsible for blowing temperature-controlled air into said intermediate space.

As shown in the detailed close-up in FIGS. 2A-2B and FIGS. 4A-4B, the door comprises a centering profile (11) for the canvases (3*a*, 3*b*) between the upper end of the guides (2*a*,2*b*).

As shown in the detailed views of FIGS. 2A-2B and 4A-4B, the connection profile (4), in this case with a triangular-shaped general cross-section has several parallel slots (41) to secure the upper end of the two canvases (3*a*,3*b*) and a first end of the band coupled to the winding roller (6).

In this exemplary embodiment, the canvases (3*a*, 3*b*) and the band coupled to the winding roller (6) are secured to the connection profile in a known manner by inserting a series of thicknesses in the canvases (3*a*, 3*b*) into the slots (41) and into the band coupled to the winding roller (6) created with the respective round beads.

The winding roller comprises a first longitudinal slot (62) to secure a second end of the band coupled to the winding roller (6), and a second longitudinal slot (63) that holds the connection profile (4) when the canvases (3*a*, 3*b*) are wound on the roller (6) as shown in FIG. 4.

In this wound position, the connection profile (4) and the connection zones between it and the canvases (3*a*, 3*b*) and the band coupled to the winding roller (6) are recessed with respect to the general cylindrical surface area of the winding roller, avoiding any bumps that could cause marks or deformation of the canvases (3*a*, 3*b*).

Figure 2A:
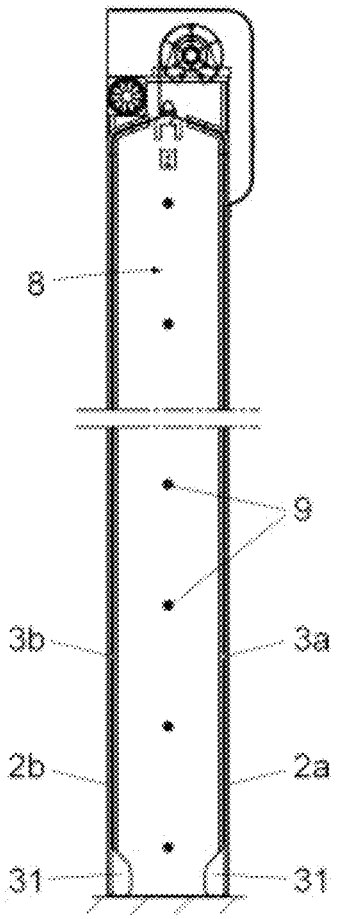
FIG. 2A shows a profile view of the double-canvas door in the previous figure cut by a vertical plane.
Figure 2B:
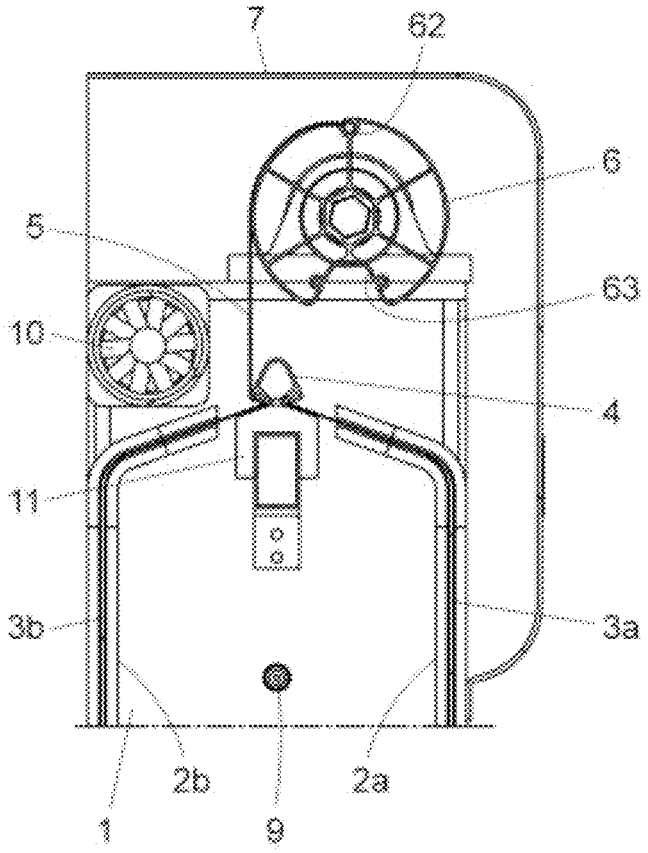
FIG. 2B is a detailed close-up view of FIG. 2A showing an upper portion of the door.
Figure 3B:
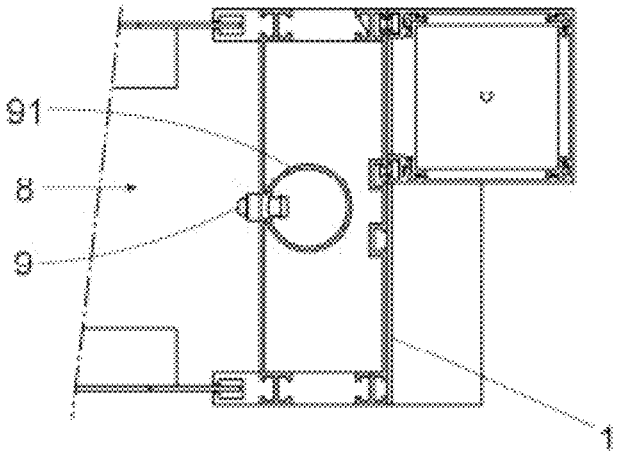
FIG. 3B is a detailed close-up view of FIG. 3A showing a side end portion of the door.
Figure 3A:
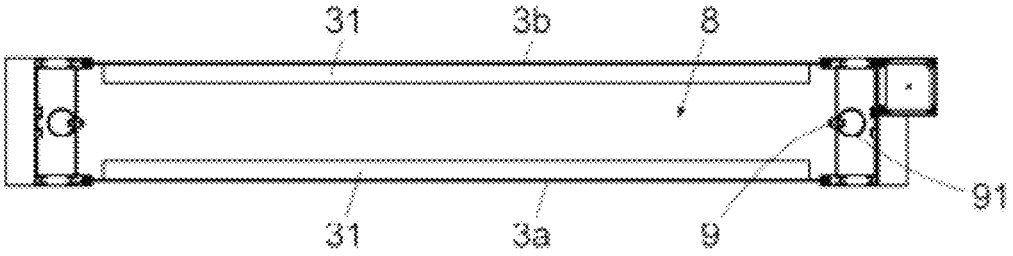
FIG. 3A shows a plan view from above of the double-canvas door in FIG. 1 cut by a horizontal plane.
Figure 4A:
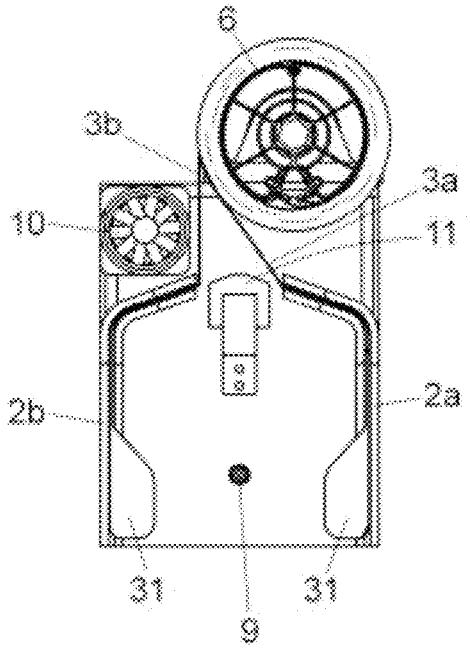
FIG. 4A shows a close up profile view of an upper portion of the door, which shows the canvases in the open position.
Figure 4B:
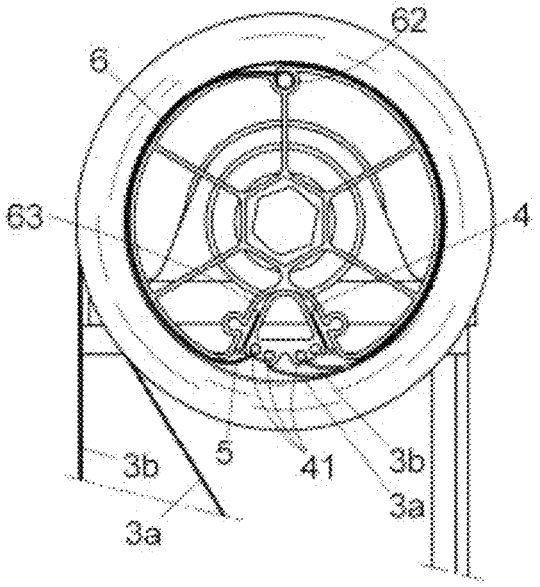
FIG. 4B is a detailed close-up view of the roller in FIG. 4A, which shows the connection profile of the canvases and the band, fit into the second longitudinal slot of the shaft.

As shown in the detailed view of FIG. 2B, the connection of the upper end of the canvases (3*a*, 3*b*) to the connection profile (4) closes the top of the intermediate chamber (8), which helps maintain the existing temperature conditions in the atmosphere of said intermediate chamber (8).

Having sufficiently described the nature of the invention, as well as a preferred embodiment, it is hereby stated for the pertinent purposes that the materials, shape, size, and arrangement of the described elements may be modified, provided that this does not alter the essential characteristics of the invention that is claimed below.

The invention claimed is:

1. A double-canvas door comprising:

a frame (1);

a pair of guides (2*a*, 2*b*) provided on each side of the frame (1);

two canvases (3*a*, 3*b*) movable along the guides (2*a*, 2*b*) between a door-open position and a door-closed position, with each canvas (3*a*, 3*b*) enclosed within and moving along one of the pair of guides (2*a*, 2*b*);

an intermediate chamber (8) defined between the two canvases (3*a*, 3*b*) in the closed position;

a single motor-driven roller (6) on which both canvases (3*a*, 3*b*) are simultaneously windable; and a single motor (61) actuating the motor-driven roller (6); wherein:

the two canvases (3*a*, 3*b*) have respective upper ends connected to one another;

a connecting band (5) is connected to the upper ends of the two canvases (3*a*, 3*b*), which are connected to one another, and coupled to the motor-driven roller (6); and an upper end of the intermediate chamber (8) is closed by the upper ends of the two canvases (3*a*, 3*b*) and a connection profile (4) when the canvases (3*a*, 3*b*) are in the door-closed position.

2. The door according to claim 1, wherein the connection profile (4) has several parallel slots (41) to which the upper ends of the two canvases (3*a*, 3*b*) and a first end of the connecting band (5) are secured.

3. The door according to claim 2, wherein the motor-driven roller (6) comprises a first longitudinal slot (62) to which a second end of the connecting band (5) is secured, and a second longitudinal slot (63) that holds the connection profile (4) when the connecting band (5) and canvases (3*a*, 3*b*) are wound on the roller (6).

4. The door according to claim 1, further comprising a centering profile (11) which centers the upper ends of the two canvases (3*a*, 3*b*), which are connected to one another, between the upper ends of the guides (2*a*, 2*b*) when the two canvases (3*a*, 3*b*) are in the closed position.

5. The door according to claim 2, further comprising a centering profile (11) which centers the upper ends of the two canvases (3*a*, 3*b*), which are connected to one another, between the upper ends of the guides (2*a*, 2*b*) when the two canvases (3*a*, 3*b*) are in the closed position.

6. The door according to claim 3, further comprising a centering profile (11) which centers the upper ends of the two canvases (3*a*, 3*b*), which are connected to one another, between the upper ends of the guides (2*a*, 2*b*) when the two canvases (3*a*, 3*b*) are in the closed position.

* * * * *